US006016034A

United States Patent [19]

Corazza et al.

[11] Patent Number: 6,016,034

[45] Date of Patent: Jan. 18, 2000

[54] METHOD FOR FORMING SUPPORTED THIN LAYERS OF NON-EVAPORABLE GETTER MATERIAL AND GETTER DEVICES FORMED THEREBY

[75] Inventors: Alessio Corazza, Como; Claudio Boffito; Alessandro Gallitognotta, both of Milan, all of Italy; Richard C. Kullberg; Michael L. Ferris, both of Colorado Springs, Colo.

[73] Assignee: SAES Getters S.p.A., Milano, Italy

[21] Appl. No.: 09/154,800

[22] Filed: Sep. 17, 1998

Related U.S. Application Data

[62] Division of application No. 08/855,080, May 13, 1997, Pat. No. 5,882,727.

[30] Foreign Application Priority Data

Jul. 23, 1996 [IT] Italy ..... MI96A1533

[51] Int. Cl.[7] ..... H01J 17/24

[52] U.S. Cl. ..... 313/553; 250/214 VT

[58] Field of Search ..... 250/214 VT; 313/553

[56] References Cited

U.S. PATENT DOCUMENTS

| | | | |
|---|---|---|---|
| 3,652,317 | 3/1972 | della Porta et al. . | |
| 3,856,709 | 12/1974 | della Porta et al. | 252/463 |
| 3,926,832 | 12/1984 | Barosi | 232/181.6 |
| 3,975,304 | 8/1976 | della Porta et al. | 252/463 |
| 4,628,198 | 12/1986 | Giorgi | 250/213 VT |
| 5,523,165 | 6/1996 | Walter et al. | 428/464 |

FOREIGN PATENT DOCUMENTS

| | | |
|---|---|---|
| 1132524 | 3/1955 | France . |
| 1067942 | 10/1959 | Germany . |
| 1270698 | 6/1968 | Germany . |
| 923787 | 4/1963 | United Kingdom . |
| WO 95/23425 | 8/1995 | WIPO . |

*Primary Examiner*—Janyce Bell
*Attorney, Agent, or Firm*—Hickman Stephens & Coleman, LLP

[57] ABSTRACT

A method for forming a supported thin layer of non-evaporable getter (NEG) material and a getter device formed thereby are provided. A suspension comprised of non-evaporable getter (NEG) material particles in a dispersing medium is prepared. The NEG material particles in the suspension have a particle size not greater than about 150 μm. The dispersing medium has an aqueous, alcoholic, or hydroalcoholic base and contains not more than about 1 wt % of organic compounds having a boiling temperature of at least about 250° C. The ratio of the weight of the NEG material particles to the weight of the dispersing medium is between about 4:1 and about 1:1. A layer of the suspension is deposited on a carrier by a serigraphic technique. Next, the deposited layer is dried to evaporate volatile components of the dispersing medium and thereby form a dried deposit. Finally, the dried deposit is sintered under vacuum at a temperature between about 800° C. and 1000° C. with a surface of the dried deposit covered with a refractory material to inhibit scaling. Getter devices formed in accordance with this method also are provided.

5 Claims, 3 Drawing Sheets

METHOD FOR FORMING SUPPORTED THIN LAYERS OF NON-EVAPORABLE GETTER MATERIAL AND GETTER DEVICES FORMED THEREBY

CROSS-REFERENCE TO RELATED APPLICATIONS

This application is a divisional of application Ser. No. 08/855,080, filed May 13, 1997, now U.S. Pat. No. 5,882, 727 the disclosure of which is incorporated herein by reference.

CLAIM FOR PRIORITY

This patent application claims priority under 35 U.S.C. § 119 from Italian Patent Application Serial No. MI96A001533, filed Jul. 23, 1996, which is incorporated herein by reference for all purposes.

BACKGROUND OF THE INVENTION

The present invention relates to getter devices and, more particularly, to a method for forming supported thin layers of non-evaporable getter (NEG) material and the getter devices formed by this method.

Non-evaporable getter (NEG) materials have been used for the past thirty years in devices in which a vacuum must be maintained for proper operation such as, for example, lamps and evacuated insulating jackets of thermos devices. The most common NEG materials are metals such as Zr, Ti, Nb, Ta, V, and alloys thereof which include at least one other element. For example, commercially available NEG materials produced by SAES Getters S.p.A. of Milan, Italy, include the alloys sold under the trade names St 101® and St 707™. The St 101® alloy has a composition of 84 wt % Zr and 16 wt % Al. The St 707™ alloy has a composition of 70 wt % Zr, 24.6 wt % V, and 5.4 wt % Fe.

In recent years, the importance of planar manufacturing technologies, by which microelectronic devices are produced on substrates generally made of silicon by depositing and selectively removing layers of materials having different electrical properties, has increased. The typical thickness of these planar devices is on the order of a few tenths of a micron. The planar manufacturing operations used to produce microelectronic devices are relatively easy to automate and yield high quality devices. As a result, such planar manufacturing technologies are driving the "planarization" of manufacturing processes in other fields such as optoelectronics and miniaturized mechanical devices. Examples of developing products reflecting this trend include flat panel displays, which may be either the vacuum type or the type with plasma inside referred to as "plasma displays," and so-called "micromachines," i.e., micromechanical devices such as, for example, car accelerometers manufactured by the same techniques used in the field of microelectronics. For devices in which a vacuum is needed, this trend toward planarization requires the development of planar getter devices.

A planar getter device is generally formed by depositing a layer of particles of NEG material deposited onto a suitable carrier, typically a metal sheet. A getter device of this type must have a particle loss as low as possible, preferably zero, as well as excellent values of gas sorption rate and gas sorption capacity. These properties are difficult to obtain simultaneously because the adhesion of the particles of NEG material to one another as well as to the substrate is typically enhanced by sintering heat treatments at high temperatures, which generally impair the porosity of the layer and hence at least its sorption rate.

Supported planar NEG devices may be manufactured by, for example, cold lamination of powders onto a supporting metal tape, as disclosed in U.S. Pat. Nos. 3,652,317, 3,856, 709, and 3,975,304. One of the problems with this technique, however, is that the thickness of the deposit is limited to the average size of the particles of NEG material. Moreover, should the NEG material have a hardness comparable to or lower than that of the substrate, the pressure exerted by the compression rollers causes a distortion of the particles which decreases the surface area and therefore the gas sorption efficiency.

Planar getter devices also can be manufactured by electrophoresis, as disclosed, for example, in U.S. Pat. No. 4,628,198. The primary disadvantage of this technique, however, is that layers of NEG material can be formed without difficulty only up to a thickness of about 50 $\mu$m. Thicker deposits require long times which are impractical from an industrial point of view. Furthermore, in the electrophoretic technique, the particles are deposited onto the substrate from a liquid suspension and are moved in a charged state by an applied electrical field. A few interesting NEG materials, such as the previously described St 707™ alloy, are difficult to electrostatically charge, which makes it difficult to manufacture getter devices including such materials by this technique.

Another technique for producing planar getter devices involves the spray of a suspension containing getter material particles onto a substrate, as disclosed in Patent Application WO 95/23425. When a deposit is produced in this manner, however, a significant amount of the suspension is atomized outside the substrate and, consequently, is lost.

In view of the above, what is needed is a method for forming a supported thin layer or film of getter material having excellent gas sorption and powder loss properties.

SUMMARY OF THE INVENTION

The present invention fills this need by providing a method for forming a supported thin layer of non-evaporable getter (NEG) material having excellent gas sorption and powder loss properties.

In accordance with one aspect of the present invention, a method for forming a supported thin layer of non-evaporable getter (NEG) material is provided. A suspension comprised of NEG material particles in a dispersing medium is prepared. The NEG material particles in the suspension have a particle size not greater than about 150 $\mu$m. The dispersing medium has an aqueous, alcoholic, or hydroalcoholic base and contains not more than about 1 wt % of high-boiling point organic compounds which have a boiling temperature of at least about 250° C. The ratio of the weight of the NEG material particles to the weight of the dispersing medium is between about 4:1 and about 1:1.

A layer of the suspension is deposited on a carrier by a serigraphic technique. Next, the deposited layer is dried to evaporate volatile components of the dispersing medium and thereby form a dried deposit. Finally, the dried deposit is sintered under vacuum at a temperature between about 800° C. and 1000° C. with a surface of the dried deposit covered with a refractory material to inhibit scaling.

In one preferred embodiment, the NEG material is a metal selected from the group consisting of Zr, Ti, Nb, Ta, V, and alloys thereof with one or more other metals, the NEG material particles have a particle size between about 5 $\mu$m and about 70 $\mu$m, the dispersing medium contains not more than about 0.8 wt % of high-boiling point organic compounds, and the ratio of the weight of the NEG material to the weight of the dispersing medium in the suspension is between about 2.5:1 to about 1.5:1.

In accordance with another aspect of the present invention, getter devices formed in accordance with the method of the invention are provided.

These and other features and advantages of the present invention will become apparent upon reading the following detailed description and studying the various figures of the drawings.

DETAILED DESCRIPTION OF THE PREFERRED EMBODIMENTS

Figure 1:
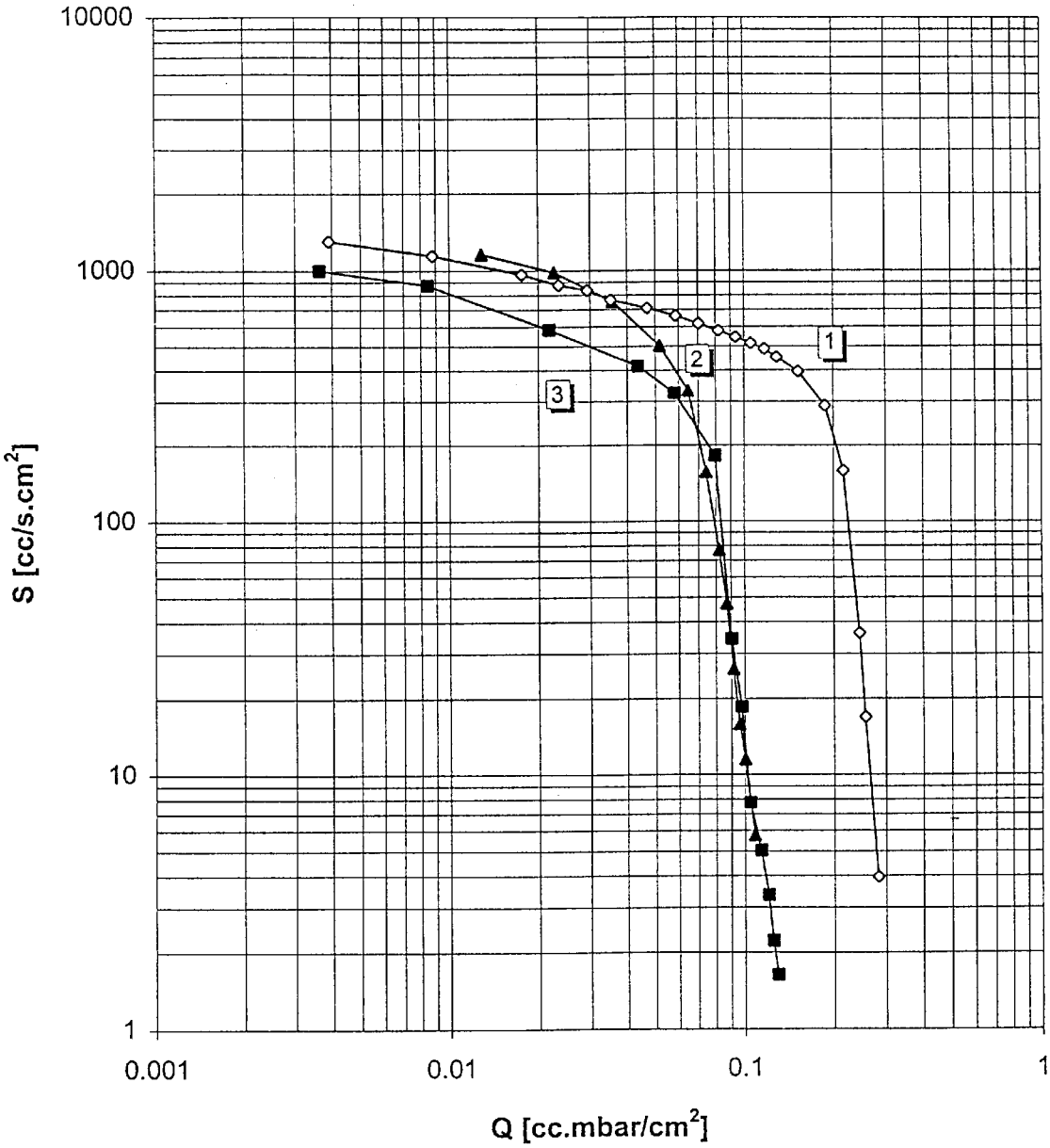
FIG. 1 is a graph showing the gas sorption lines for a thin layer sample of getter material formed in accordance with the method of the invention and for two comparison samples.

In contrast with other methods, e.g., the electrophoretic method, the method of the present invention enables the formation of layers from any non-evaporable getter (NEG) material, as well as combinations of such materials. Exemplary non-evaporable getter (NEG) materials include metals such as Zr, Ti, Ta, Nb, V, and alloys thereof with one or more different elements, the St 101® and St 707™ alloys discussed above, and the $Zr_2Fe$ and $Zr_2Ni$ compounds produced by SAES Getters S.p.A. of Milan, Italy, and sold under the trade names St 198 and St 199, respectively. Those skilled in the art will recognize that other alloys known in this field based on zirconium or titanium also may be used in the method of the invention.

In accordance with the invention, at least one suspension of NEG material in a dispersing medium is prepared. The NEG material is in the form of a powder having a particle size not greater than about 150 $\mu$m. Those skilled in the art are familiar with screening techniques for obtaining a powder having a suitable particle size. With particle sizes above about 150 $\mu$m, it is difficult to obtain a homogeneous deposit. A preferred range of particle sizes is between about 5 $\mu$m and about 70 $\mu$m.

The dispersing medium for the NEG material particles is a solution having an aqueous, alcoholic, or hydroalcoholic base and which contains not more than about 1 wt % of high-boiling point organic compounds which have a boiling temperature of at least about 250° C. An example of a suitable aqueous base is distilled water. Suitable alcoholic bases include, but are not limited to, low molecular weight alcohols such as ethanol, propanol(s), and butanol(s). Suitable hydroalcoholic bases have a solvent which is a mixture of water and the previously described alcohols. For reasons discussed below, the amount of high-boiling point organic compounds is preferably not more than about 0.8 wt %. Dispersing media used for serigraphy usually have high contents of organic components, which are used as binders. The organic components left in the deposit after drying can decompose to form gases such as CO, $CO_2$, or nitrogen oxides at a temperature of from about 200° C. to 400° C. during the subsequent sintering phase. At such temperatures, the particles of NEG material are already at least partially activated and can therefore sorb these gases, which results in a reduction of the sorption capacity of the resultant getter device.

It has been found that thin layers of NEG material serigraphically deposited using a dispersing medium containing more than about 1 wt % of high-boiling point organic compounds have poor gas sorption properties. On the other hand, the dispersing medium preferably contains at least about 0.2 wt % of high-boiling point organic compounds. At lower concentrations of such compounds, the viscosity of the suspension is too low. Under these conditions, the final form of the deposit is defined by the surface tension of the solvent and by the solvent wettability of the carrier and of the web of the serigraphic screen. The solvent's surface tension tends to form suspension drops on the carrier, in larger proportion when the solvent wettability of the carrier is low. Moreover, when the serigraphic screen is formed of a material having high solvent wettability, during peeling of the screen from the deposit the suspension tends to stick to the threads of the screen to a greater extent, which results in an accumulation of excessive amounts of NEG material in the region of the meniscus formed between the suspension and the screen. The total result of these effects cannot be forecast and changes as a function of the material used for the carrier and for the serigraphic screen, but nonetheless coincides with the formation of an uneven deposit.

The ratio of the weight of the NEG material to the weight of the dispersing medium is between about 4:1 and about 1:1, and preferably between about 2.5:1 and about 1.5:1. When the ratio of the weight of the NEG material to the weight of the dispersing medium exceeds about 4:1, the suspension is not sufficiently fluid and gives rise to agglomerates which are poorly distributed onto the serigraphic screen and which do not readily pass through the screen mesh. On the other hand, the lower limit for the relative amount of the NEG material is based on productivity considerations. From a technical perspective, there is nothing to prevent the use of suspensions containing very low amounts of NEG material, but a layer with little material and hence poor capacity is obtained. Furthermore, when the amount of NEG material per unit surface area is too low, the deposit tends to be uneven and the gas sorption properties are unreproducible from device to device.

The thus prepared suspension is deposited onto a carrier by a serigraphic technique. This technique is known for other applications, such as, for example, the reproduction of drawings on adapted surfaces or the deposition of conductive tracks for a printed circuit. Suitable materials for the formation of the carrier include, but are not limited to, metals such as steel, titanium, nickel-plated iron, constantan, nickel/chromium alloys, and nickel/iron alloys. The carrier generally has a thickness between about 20 $\mu$m and about 1 mm. The deposit may be in the form of a continuous layer covering an entire surface of the carrier or, if desired, the carrier's edges may be left uncovered to facilitate handling of the final sheet. Those skilled in the art will recognize that the serigraphic technique also enables the formation of partial deposits on the surface of the carrier so that many different geometries for the NEG material deposits can be obtained. To form a shaped deposit, the ports of the serigraphic screen are selectively blocked in a desired pattern by means of a gel which cannot be etched by the suspension to be deposited. The obtained deposit will have the geometry of the gel negative, i.e., the geometry corresponding to the ports of the screen which are not blocked with gel. In this manner, continuous deposits having complicated shapes such as, for example, a spiral can be obtained. Discontinuous deposits, i.e., deposits forming a plurality of discrete deposit zones on the same carrier, with, for example, circular, square, or linear shapes also can be obtained.

The thus obtained deposit is then dried to eliminate as much of the dispersing medium as possible. Drying may be performed in an oven at a temperature between about 50° C. and about 200° C., in a gaseous flow or in a static atmosphere. During drying, the volatile components of the dispersing medium are evaporated.

The dried deposit is then sintered under a vacuum at a temperature between about 800° C. and 1000° C., depending on the type of NEG material. Preferably, sintering occurs in a vacuum oven at a residual pressure lower than 0.1 mbar. Depending on the ultimate temperature reached, the sintering time may be from about 5 minutes to about 2 hours. At the end of the sintering treatment, the deposit may be cooled under vacuum or, to accelerate the rate of cooling, in a stream of inert gas. Cooling also may be accomplished using a combination of these two conditions.

If desired, the drying and sintering treatments may occur as subsequent steps of a single thermal treatment. For example, the sample may be placed in a vacuum oven and, after the oven is exhausted to a pressure lower than 0.1 mbar, heated to a temperature between about 50° C. and about 200° C. The sample may be held at such temperature for a predetermined time between about 10 minutes and about one hour. Alternatively, the variation of pressure values in the oven may be monitored. In this case, the drying step is considered complete when pressure increases, which occur as the result of the evaporation of volatile components of the dispersing medium, cease to occur. Upon completion of drying, the sample may be heated under vacuum to the sintering temperature. Depending on the chemical nature of the components of the dispersing medium and of the NEG material, more complicated thermal cycles also may be used. By way of example, treatment periods at a constant temperature or at temperatures between the drying temperature and the sintering temperature may be used. These treatments may be particularly useful in the elimination of the last traces of organic components, by allowing them to decompose at a temperature at which the NEG material is not yet activated.

During sintering, the surface of the dried deposit is covered with a refractory material to inhibit scaling of the surface. As used in connection with the description of the invention, the term "refractory material" means any material which is physically and chemically inert, i.e., is not subjected to any physical or chemical alteration, under vacuum over the temperature range of the sintering cycle. If the surface of the dried deposit is exposed during sintering, then scaling of the surface occurs. Although the reason for such scaling is not yet fully understood, it has been found that covering the dried deposit's surface with a plane surface of a refractory material, i.e., a physically and chemically inert material as defined above, prevents the phenomenon from occurring. Any suitable material can be used to cover and thereby protect the deposit, provided the material does not melt or in anyway suffer from physical or chemical conversions or alterations under vacuum throughout the temperature range of the sintering cycle. By way of example, molybdenum and graphite can be used to cover the deposit's surface to inhibit scaling thereof. Those skilled in the art will recognize that the sintering of several supported deposits in the same thermal cycle may be accomplished by overlapping several sheets of supported deposit, interposing refractory material amongst such sheets or plane surfaces, and covering the surface of the uppermost sheet with a refractory material.

It is difficult to use the serigraphic technique with carriers of limited surface area because deposits produced by this technique have a relatively wide surface, i.e. larger than at least 50 $cm^2$. In general, however, the surface area available for a getter device inside a device requiring a vacuum is narrow and therefore rather limited. For example, in a flat panel display the getter device can be arranged at the edges of the screen in the shape of stripes having a width of just a few mm. In the case of "micromachines," getter devices having a geometrical surface area of just a few $mm^2$ are required. As a result, getter devices formed in accordance with the method of the invention often require a sheet cutting step. In the event the deposit is discontinuous and free portions of the supporting surface lie between one deposit zone and the next, the sheet may be cut by normal mechanical techniques such as shearing along uncovered supporting zones. If, however, a cut along lines going through one or more deposit zones is desired, then the use of a laser cutting technique, in association with a coaxial flow of argon gas, is preferred. In the laser cutting technique the sheet is cut by means of localized fusion caused by the heat developed by the laser on the metal. Simultaneously, the fusion of a very thin zone of deposit, approximately 30 $\mu$m to 40 $\mu$m wide, occurs wherein the particles of NEG material are melted with one another and with the metal carrier. This provides the cut with a "seam" and prevents the loss of particles of NEG material which could occur by mechanically cutting the deposit. The argon flow helps prevent the oxidation of the getter material.

One of the advantages associated with the preparation of layers of getter material by the serigraphic method is the ease with which multiple layers can be formed. The multiple layers may include layers of different materials and the different layers need not have the same pattern. For example, two overlapping continuous layers can be deposited. Alternatively, the deposit may include a continuous layer of a first material on the carrier and a discontinuous layer of discrete zones of a second material over the layer of the first material. In a still further alternative, the reverse structure, i.e. a structure in which the discontinuous deposit layer directly contacts the carrier and the continuous layer covers the discontinuous layer, can be deposited. This latter structure is particularly interesting because it allows getter devices to be formed which not only have excellent mechanical properties but also have a particle loss which is practically null, even when the starting NEG materials are difficult to sinter because the particles of which have poor adhesion to one another and to the carrier. An example of this kind of structure is a getter device obtained by depositing a first layer of particles of the above-described St 707™ alloy, which is difficult to sinter, and depositing a layer of nickel powder, which is easily sintered at a temperature of about 850° C., over the first layer. The layer of sintered nickel is sufficiently porous so that an adequate gas admission rate to the underlying getter alloy is obtained. At the same time, the nickel layer serves as a "cage" for the alloy deposit which prevents the loss of getter alloy particles inside the vacuum device. It is conceivable that overlapping layers of different materials also may be obtained, albeit with difficulty, by techniques such as electrophoresis or spraying. These techniques, however, have significant limitations such as, for example, the maximum thickness obtainable by electrophoresis. On the other hand, serigraphy is the sole technique which allows getter devices with at least one discontinuous powder layer to be formed.

EXAMPLES

The method of forming a supported thin layer of getter material of the invention will now be described in terms of specific examples. It should be borne in mind that the examples given below are merely illustrative of particular applications of the inventive method and should in no way be construed to limit the usefulness of the invention in other applications.

Example 1

This example concerns the preparation of a supported thin layer of getter material in accordance with the method of the invention.

A suspension of powders of getter material was prepared using a mixture consisting of 70 g of titanium hydride, 30 g of St 707™ alloy, and 40 g of a dispersing medium supplied by the firm KFG ITALIANA under the trade name "Trasparente ad Acqua 525/1," made as an aqueous base having a content of high-boiling point organic material lower than 0.8% by weight. The powders have a particle size lower than 60 $\mu$m. The two components were mixed for about 20 minutes in order to obtain a homogeneous suspension. Such a suspension was dispensed onto a frame for serigraphic printing having 24 threads/cm mounted on a serigraphic machine (CUGHER Model MS 300). The frame screen had been previously shielded along its periphery by a masking tape affixed to the side which, during the layer deposition, is in contact with the carrier. The tape defines a rectangular deposition area of 11×15 cm and maintains, during the printing phase, such a spacing between frame and substrate to allow the deposition of a film of material of about 50 $\mu$m. The suspension was deposited onto a substrate of an alloy containing 80 wt % nickel/20 wt % chromium (Ni/Cr), having a thickness of 50 $\mu$m. The sheet with the deposited material, after a first drying step of 30 minutes in air at room temperature, was interposed between two molybdenum plates and placed into a vacuum oven. The oven evacuation was started and as the pressure approached a value of $5\times10^{-4}$ mbar a thermal treatment was initiated, always under pumping. The thermal cycle was as follows: heating from room temperature to 200° C. in 20 minutes; maintaining the temperature at 200° C. for 20 minutes; heating from 200° C. to 550° C. in 60 minutes; maintaining the temperature at 550° C. for 60 minutes; heating from 550° C. to 850° C. in 60 minutes; maintaining the temperature at 850° C. for 40 minutes; and natural cooling under vacuum to about 350° C. followed by accelerated cooling by flowing some mbar of argon at a temperature below this temperature into the oven's chamber.

The sheet with the deposit of sintered getter material was withdrawn from the oven at room temperature and a stripe of 1×5 cm was cut therefrom by means of laser cutting, which stripe was completely covered with getter material, whereupon the hereinafter described gas sorption tests were carried out. This stripe forms Sample 1.

Example 2

Comparative

This comparative example concerns the preparation of a supported thin layer of getter material by means of a technique different from the method of the invention.

A 50 $\mu$m layer of getter material was prepared on a Ni/Cr sheet of 50 $\mu$m according to the spray deposition technique disclosed in Patent Application WO 95/23425. The getter material and its particle size were the same as in Example 1. The deposit was sintered in accordance with the same thermal cycle used in Example 1. From the sheet with the deposit of sintered getter material, a 1×5 cm stripe was cut by laser cutting, with the stripe being completely covered with getter material, whereupon the hereinafter described gas sorption tests were performed. This stripe forms Comparative Sample 2.

Example 3

Comparative

This comparative example concerns the preparation of a supported thin layer of getter material by means of another technique different from the method of the invention.

A 50 $\mu$m layer of getter material was prepared on a Ni/Cr sheet of 50 $\mu$m according to the electrophoretic deposition technique disclosed in U.S. Pat. No. 4,628,198. The getter material and its particle size were the same as in Example 1. The deposit was sintered in accordance with the same thermal cycle used in Example 1. From the sheet with the deposit of sintered getter material, a 1×5 cm stripe was cut by laser cutting, with the stripe being completely covered with getter material, whereupon the hereinafter described gas sorption tests were performed. This stripe forms Comparative Sample 3.

Example 4

Comparative

This comparative example concerns the preparation of a supported thin layer of getter material using a dispersing medium different from that used in the method of the invention.

The procedure of Example 1 was repeated, with the exception that the dispersing medium for the suspension had the following composition: 4.45 wt % aluminum flakes, 44.5 wt % $Al(NO_3)_3$ and 51.05 wt % of distilled $H_2O$, i.e., free from organic compounds. The thus-obtained sintered deposit had extremely poor adhesion to the carrier and peeled therefrom in the form of flakes. The mechanical properties of this deposit were not sufficient to use the same in technological applications where a getter device is required and, consequently, no sorption tests were performed on this sample.

Example 5

Comparative

This comparative example concerns the preparation of a supported thin layer of getter material using a dispersing medium different from that used in the method of the invention.

The procedure of Example 1 was repeated, with the exception that the dispersing medium for the suspension had the following composition: 1.5 wt % of collodion cotton, 40 wt % butyl acetate, and 58.5 wt % isobutanol. From the sheet with the deposit of sintered getter material, a 1×5 cm stripe was cut by laser cutting, with the stripe being completely covered with getter material, whereupon the hereinafter described gas sorption tests were performed. This stripe forms Comparative Sample 5.

Example 6

Figure 3:
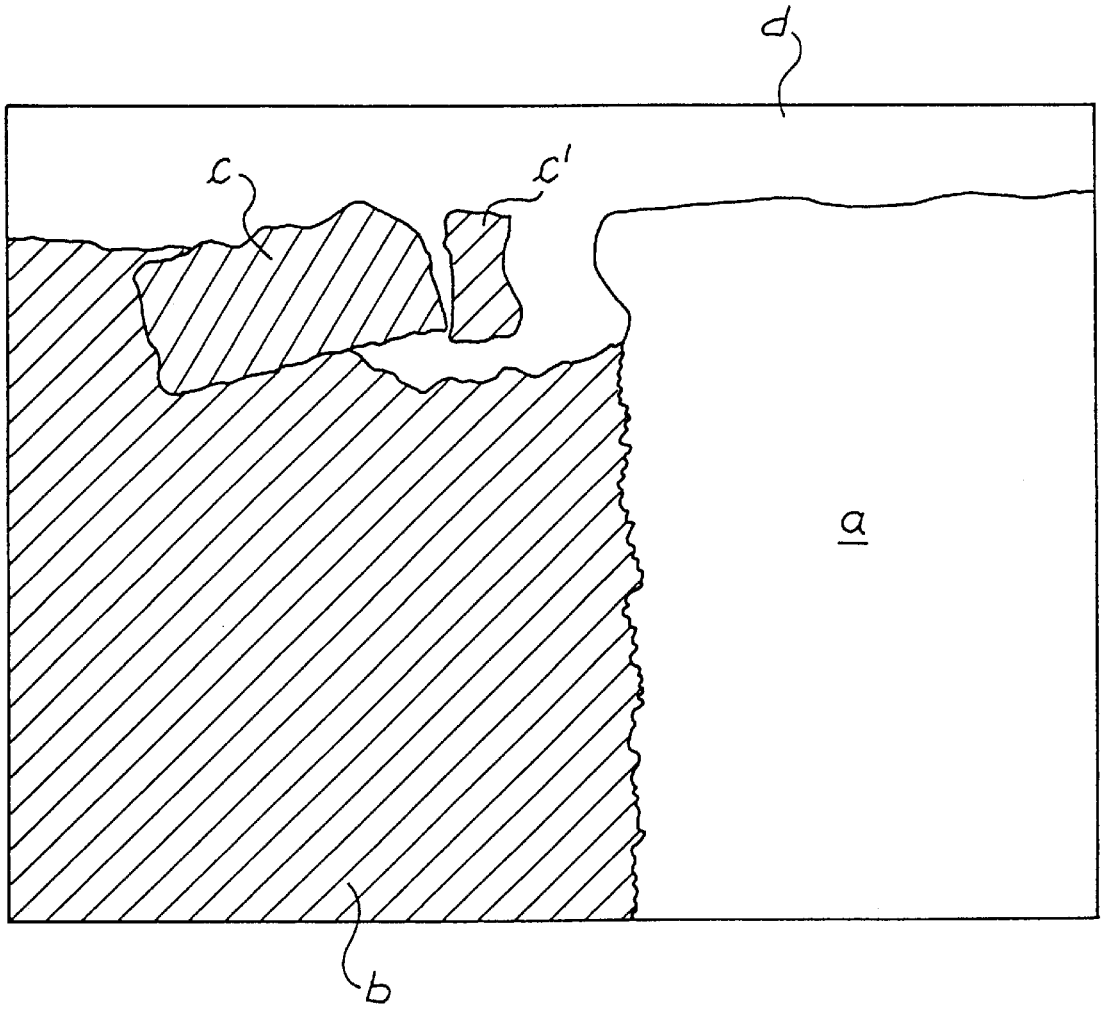
FIG. 3 is a diagram which reproduces a plan view from above the surface of a sample in which half of the surface of the sample is prepared in accordance with the method of the invention.

The procedure of Example 1 was repeated, with the exception that during sintering only half of the deposit of getter material was covered with a molybdenum sheet. The deposit obtained after sintering forms Sample 6. A diagrammatic reproduction, which is a partial plan view from above, of the covered zone and the zone left uncovered by molybdenum during the sintering of Sample 6 is shown in FIG. 3.

Example 7

The gas sorption capacity of Sample 1 and Comparative Samples 2 and 3 was measured in accordance with the method prescribed by the standard rule ASTM F 798-82. As a test gas, carbon monoxide (CO) was used. The results of these tests are shown in FIG. 1, as lines 1, 2, and 3, respectively, wherein the amount of sorbed gas is recorded as an abscissa and the sorption rate as an ordinate.

Example 8

The gas sorption capacity of Sample 1 and Comparative Sample 5 was measured in accordance with the method prescribed by the standard rule ASTM F 798-82. As a test gas, carbon monoxide (CO) was used. The results of these tests are shown in FIG. 2, as lines 1 and 5, respectively, using the same abscissa and ordinate as in the graph of FIG. 1.

It is apparent from a comparison of lines 1, 2, and 3 in the graph of FIG. 1 that the getter device formed in accordance with the method of the invention has excellent gas sorption properties, which are better than those for devices having the same geometrical size but which are prepared using different techniques.

Figure 2:
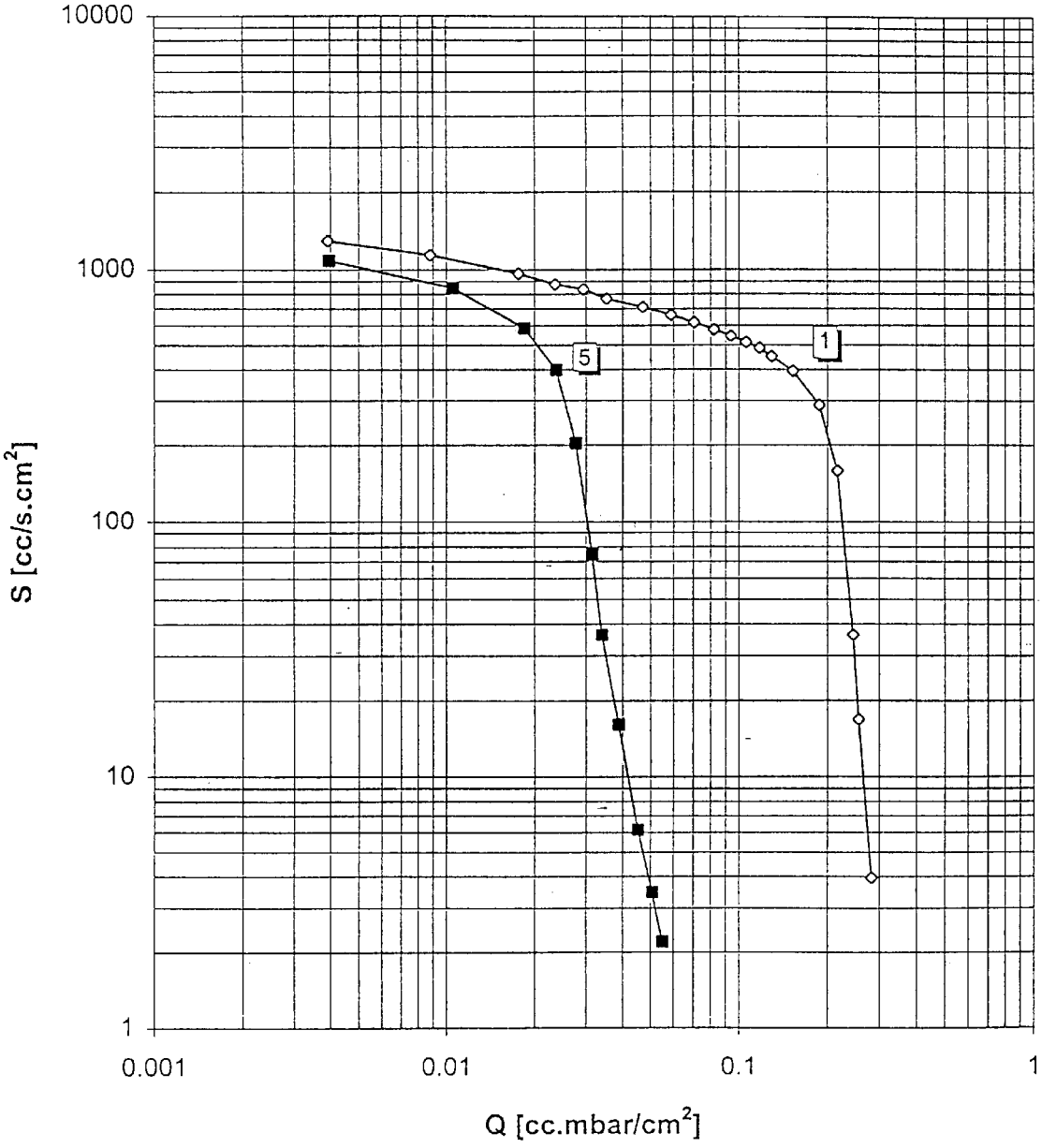
FIG. 2 is a graph showing the gas sorption lines for a thin layer sample of getter material formed in accordance with the method of the invention and for a further comparison sample.

Moreover, analysis of the graph in FIG. 2 confirms the significance of using a dispersing medium having a low concentration of high-boiling point carbon compounds. Although it would be expected that the drying and sintering heat treatments to which the deposit is subjected would remove any trace of these compounds, it is apparent from the graph that Sample 5, which was formed using a suspension having high contents of high-boiling carbon compounds, has inferior gas sorption properties relative to those of Sample 1 prepared in accordance with the method of the invention.

Finally, the effect of covering the deposit with a refractory material during sintering is shown in FIG. 3. In this figure, the zone covered during sintering is designated as "a" and the uncovered zone is designated as "b." The exposed surface portion, i.e. the uncovered zone, has poor adhesion to carrier d, as demonstrated by the deposit scales c, c' which peel from the carrier. On the other hand, such scaling does not occur in the covered zone "a."

While this invention has been described in terms of several preferred embodiments, there are alterations, permutations, and equivalents which fall within the scope of this invention. It should also be noted that there are many ways of implementing the methods and devices of the present invention. It is therefore intended that the following claims be interpreted as including all such alterations, permutations, and equivalents as fall within the true spirit and scope of the present invention.

What is claimed is:

1. A getter device having a supported thin layer of getter material formed by a method comprising:

preparing at least one suspension comprised of non-evaporable getter (NEG) material particles in a dispersing medium, said NEG particles having a particle size not greater than about 150 $\mu$m, said dispersing medium having an aqueous, alcoholic, or hydroalcoholic base and containing not more than about 1 wt % of organic compounds having a boiling temperature of at least about 250° C., wherein a ratio of a weight of said NEG material particles to a weight of said dispersing medium is between about 4:1 and about 1:1;

depositing at least one layer of said suspension on a carrier by a serigraphic technique;

drying said at least one deposited layer to evaporate volatile components of said dispersing medium and thereby form a dried deposit; and sintering said dried deposit under vacuum at a temperature between about 800° C. and about 1000° C. with a surface of said dried deposit covered with a refractory material to inhibit scaling, whereby a layer comprised of NEG material supported on said carrier is obtained.

2. The getter device of claim 1, wherein at least two layer s of different materials are deposited by the serigraphic technique.

3. The getter device of claim 2, wherein the device includes a layer comprised of nickel disposed over the layer comprised of NEG material.

4. The getter device of claim 2, wherein at least one layer includes a plurality of discrete deposit zones.

5. The getter device of claim 4, wherein the at least one layer including discrete deposit zones is comprised of NEG material.

* * * * *

UNITED STATES PATENT AND TRADEMARK OFFICE

CERTIFICATE OF CORRECTION

PATENT NO. : 6,016,034
DATED : January 18, 2000
INVENTOR(S) : Corazza et al.

It is certified that error appears in the above-identified patent and that said Letters Patent is hereby corrected as shown below:

Title page,
Item [56], References Cited, immediately before "*Primary Examiner*--Janyce Bell" add the following:

-- OTHER PUBLICATIONS
Giorgi, E.; Ferrario, B.; Boffito, C., "High-porosity coated getter"; Journal of Vacuum Science and Technology, Part A, vol. 7, no. 2; March, 1989 --

Column 10,
Lines 36-38, reads:
"2. The getter device of claim 1, wherein at least two layer
s of different materials are deposited by the serigraphic
technique.";
It should read :
-- 2. The getter device of claim 1, wherein at least two layers
of different materials are deposited by the serigraphic
technique. --

Signed and Sealed this

Sixth Day of August, 2002

*Attest:*

*Attesting Officer*

JAMES E. ROGAN
*Director of the United States Patent and Trademark Office*